United States Patent [19]

DeForrest, Sr.

[11] Patent Number: 4,861,079

[45] Date of Patent: Aug. 29, 1989

[54] MULTI-PURPOSE LOCK BOLT

[76] Inventor: William DeForrest, Sr., 1825 Via Burton, Anaheim, Calif. 92806

[21] Appl. No.: 128,053

[22] Filed: Dec. 3, 1987

[51] Int. Cl.[4] ..... E05C 1/04

[52] U.S. Cl. ..... 292/148; 70/129; 70/DIG. 57; 292/DIG. 15; 292/DIG. 46

[58] Field of Search ..... 70/129, DIG. 57, 104, 70/131, 232; 292/148, DIG. 15, DIG. 46, DIG. 53

[56] References Cited

U.S. PATENT DOCUMENTS

| | | | |
|---|---|---|---|
| 1,047,315 | 12/1912 | Shone | 292/57 |
| 1,219,488 | 3/1917 | Rompf | 70/203 |
| 1,368,711 | 2/1921 | Foley | 292/148 |
| 1,432,640 | 10/1922 | Szalai | 292/148 X |
| 1,512,939 | 10/1924 | Ledin | 70/DIG. 57 X |
| 2,103,989 | 12/1937 | Machinist | 70/DIG. 57 X |
| 2,468,406 | 4/1949 | Mova | 70/129 |
| 2,613,970 | 10/1952 | Holmsten | 70/DIG. 57 X |
| 2,701,734 | 2/1955 | Grossman | 70/DIG. 57 X |
| 2,781,215 | 2/1957 | Griffith | 292/148 |
| 2,974,987 | 3/1961 | O'Brien | 70/129 |
| 3,334,933 | 8/1967 | Ehlers | 70/129 |
| 3,451,703 | 6/1969 | Roegner | 70/129 |
| 3,606,775 | 9/1971 | Atkins | 70/129 |
| 4,095,828 | 6/1978 | East | 70/54 X |
| 4,214,783 | 7/1980 | Boegeman | 292/DIG. 60 X |
| 4,307,904 | 12/1981 | Daus | 70/56 X |
| 4,590,777 | 5/1986 | Sierra | 70/104 |
| 4,616,493 | 10/1986 | Fazzolari et al. | 70/129 |

FOREIGN PATENT DOCUMENTS

| | | | |
|---|---|---|---|
| 96784 | 4/1898 | Fed. Rep. of Germany | 292/148 |
| 1553596 | 3/1970 | Fed. Rep. of Germany | 70/DIG. 57 |
| 418955 | 7/1910 | France | 70/129 |

*Primary Examiner*—Lloyd A. Gall

*Attorney, Agent, or Firm*—Herb Boswell

[57] ABSTRACT

A multi-purpose lock bolt has a body which includes a bolt hole, a lock shackle hole and one or more mounting holes. Each of these are formed in the body and pass through the body. The lock shackle hole intersects with and traverses across the bolt hole as do the mounting holes. An elongated bolt is sized and shaped so as to fit into and slide in the bolt hole. The elongated bolt includes an alignment hole which is located in the elongated bolt in a direction transverse to the elongated axis of the elongated bolt. The bolt slides in the bolt hole in the body between an unlocked position and a locked position wherein in the locked position the alignment hole in the elongated bolt is aligned with the lock shackle hole in the body allowing a shackle of a lock to be passed through both the lock shackle hole of the body and the alignment hole in the elongated bolt to fix the elongated bolt with respect to the body in a locked position.

19 Claims, 2 Drawing Sheets

FIG 3
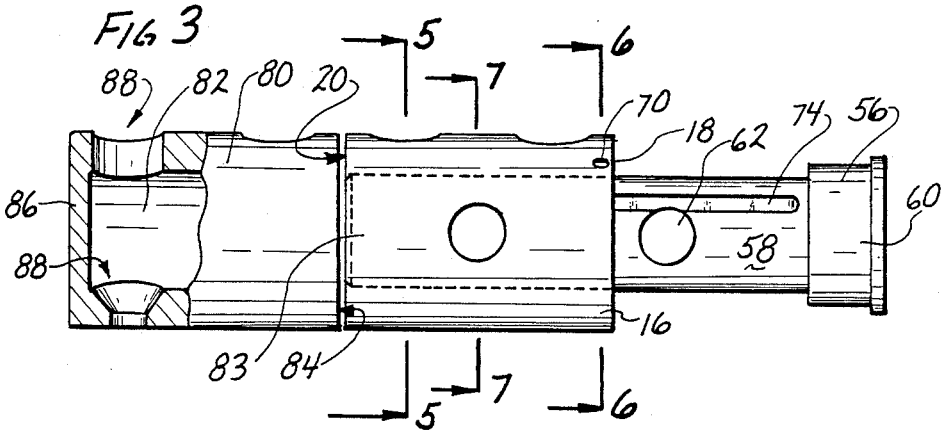
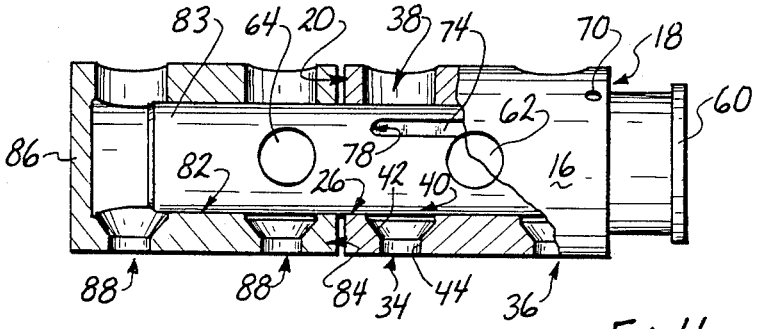
FIG 4
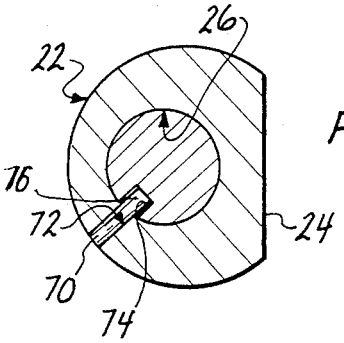
FIG 6
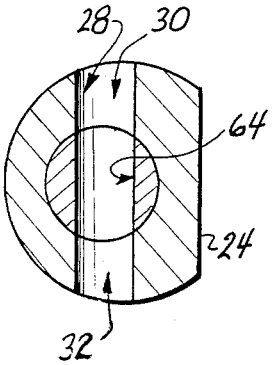
FIG 7

MULTI-PURPOSE LOCK BOLT

BACKGROUND OF THE INVENTION

This invention is directed to a multi-purpose lock bolt having a monolithic body and a bolt which slides in this monolithic body.

A variety of locking structures are known. Many of these locking structures are suitable for use on doors that swing, slide or lift. When these doors are of wood construction it is relatively straight forward to equip them to include a lock. This is easily done by boring a first hole through an edge of the door and a second hole between the faces of the door which is perpendicular to the first hole and connects with the first hole. A bolt structure such as a dead bolt latch or the like can then be inserted into these holes to secure the door to a frame.

The same type of structure as was described above for common wood doors can also be extended to certain metal doors, such as a typical aluminum frame surrounding a panel of glass utilized on office doors and the like.

Because of the advancement in materials and architectural designs many doors are now manufactured which can generally be characterized as "narrow style doors". These include garage doors which have very narrow wooden frames, aluminum frame office doors having very narrow frames, structures made out of wrought iron or steel also having narrow exterior posts, frames and the like and other type doors. For these types of doors, gates, door frames and the like many of the known types of locking structures are not suitable for a variety of reasons. In view of this there exists a need for new and improved multi-purpose locking bolts for use on narrow style doors, gates, door frames and the like.

BRIEF DESCRIPTION OF THE INVENTION

It is a broad object of this invention to provide a multi-purpose lock bolt which is capable of being utilized on a variety of structures to secure these structures. It is a further object of this invention to provide a multi-purpose lock bolt which is simple in construction and therefore economical, but concurrently is essentially ubiquitous in its application so as to be useful on a variety of different structures for securing these structures.

These and other objects as will become evident from the remainder of this specification can be achieved in a multi-purpose lock bolt which includes a body having a bolt hole, a lock shackle hole and a mounting hole each located in and passing through the body. The lock shackle hole intersects with and traverses across the bolt hole resulting in a portion of the lock shackle hole being on one side of the bolt hole in the body and a further portion of the lock shackle hole being on the opposite side of the bolt hole in the body. One or more mounting holes are also provided in the body. These mounting holes also intersect with and traversing across the bolt hole. An elongated bolt which is sized and shaped to fit into and slide in the bolt hole is located in the bolt hole and slides between a locked position wherein a portion of this bolt extends out from the bolt hole beyond the body and a unlocked position where this portion is essentially retracted into the body. The elongated bolt includes an alignment hole extending through the bolt in a direction transverse to the elongated direction of the bolt. The alignment hole is positioned in the bolt and the lock shackle hole is positioned in the body in association with each other such that the alignment hole aligns with the lock shackle hole when the elongated bolt is in its locked position. This allows for a shackle of a padlock or the like to be passed through both of the lock shackle hole and the alignment hole to fixedly position the bolt in the locked position in the body.

The above multi-purpose lock bolt can be augmented with an auxiliary body. The auxiliary body includes a bolt strike hole and at least one mounting hole located in the auxiliary body. The mounting hole intersects with and traverses across the bolt strike hole. The bolt strike hole extends at least partially into the auxiliary body from a surface of the body toward an opposite surface and is sized and shaped to accept a portion of the elongated bolt therein. The positioning of the elongated bolt within the bolt strike hole inhibits movement of the auxiliary body with respect to the body about two axes which are perpendicular to the elongated dimension of the elongated bolt.

The body of the multi-purpose locking bolt is advantageously selected as a monolithic body shaped as a cylinder having opposing end surfaces and a cylindrical surface between the end surfaces. This cylindrical body is truncated by a plane passing parallel to the cylindrical axis of the cylinder and through both of the end surfaces and the cylindrical surface to form a plane surface. The mounting holes pass through this plane surface into the body and into the bolt hole. By positioning each of the bolt hole, the lock shackle hole and the mounting holes essentially perpendicular to each other advantage is taken of the use of a monolithic body and when the body is attached to the structure the location of the bolt within the body serves to deny access to any mounting implement which is utilized in attaching the body to the structure via the mounting holes.

Two mounting holes will advantageously be selected for both the body and the auxiliary body to fixedly position these bodies to a structure. Further, advantageously an additional lock shank hole can be located in the elongated bolt allowing the elongated bolt to be locked to the body in an unlocked position.

BRIEF DESCRIPTION OF THE DRAWINGS

This invention will be better understood when taken in conjunction with the drawings wherein:

FIG. 3 is a bottom plan view in partial section of the multi-purpose lock bolt of FIG. 1 showing this lock bolt in an unlocked position;

FIG. 4 is a view similar to FIG. 3 showing the lock bolt of FIG. 3 in a locked position;

FIG. 6 is an end elevational view in section about the line 6—6 of FIG. 3; and FIG. 7 is an end elevational view in section about the line 7—7 of FIG. 3.

Figure 1:
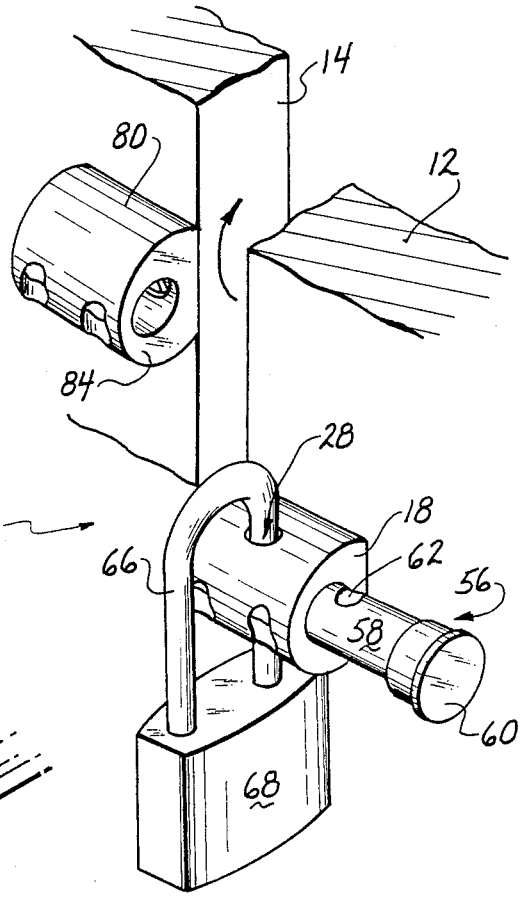
FIG. 1 is an isometric view showing a first use of the multi-purpose lock bolt of the invention on a structure.

The invention described in this specification and shown in the drawings utilizes certain principles and/or concepts as are set forth in the claims appended to this specification. Those skilled in the locksmithing arts to which this invention pertains will realize that these principles and/or concepts are capable of being utilized in a variety of different environments which may differ from the specific environment which is utilized to illustrate the invention in this specification. For this reason this invention is not to be construed as being limited to only the illustrated embodiment but should be construed in light of the claims.

DETAILED DESCRIPTION

In FIG. 1 a multi-purpose lock bolt of the invention generally depicted by the numeral 10 is shown in use in conjunction with a swinging door 12 and a further structure 14. The structure 14 could represent a door frame or a second swinging door or other structure which the door 12 is associated with. For the purposes of illustration of this invention, in FIG. 1 the door 12 is "ajar" with respect to the structure 14.

The multi-purpose lock bolt 10 has a main body 16 which is formed as a monolithic structure. It is generally shaped as a cylinder which has been truncated. It includes a first end surface 18 and a further end surface 20 (best seen in FIGS. 3 and 4). Connecting between these end surfaces 18 and 20 is a cylindrical surface 22. A plane passing parallel to the cylindrical axis of the body 16 cuts through the surfaces 18, 20 and 22 to form a back planar surface 24 best visible in FIGS. 6 and 7.

A bolt hole 26 passes through the body 16 between the two end surfaces 18 and 20.

A lock shank hole 28 is formed in the monolithic body 16 perpendicular to the bolt hole 26 and in traversing through the body 16 passes through and intersects the bolt hole 26. In doing so, the bolt hole 26 divides the lock shank hole 28 into an upper section 30 and a lower section 32.

The body 16 further includes first and second mounting holes 34 and 36 which traverse through the body 16 perpendicular to both the bolt hole 26 and the lock shank hole 28 and intersect with the bolt hole 26. The bolt hole 26 thus divides the mounting holes 34 and 36 to an outer section collectively identified by the numeral 38 and an inner section collectively identified by the numeral 40 for each of the holes 34 and 36. The outer section 38 and the inner section 40 are of different sizes and shapes. The outer sections 38 of the holes 34 and 36 are cylindrical in nature whereas the inner sections 40 includes a countersink area 42 and a narrow cylindrical area 44. The cylindrical area 44 can be threaded.

As thus formed the mounting holes 34 and 36 are capable of being utilized in a variety of ways to mount the body 16 to a structure. In a first manner of mounting the body 16 to a structure, bolts can be threaded through the structure and into the threaded cylindrical areas 44 of the inner sections 40 of the bolt holes 34 and 36. In an additional mounting method appropriate counter sunk head screws or bolts can be passed through the sections 38, through the bolt hole 26 and into the inner sections 40. These are then lodged within the countersink areas 42 with the threads of these bolts passing through the cylindrical areas 40 and extending beyond the back planar surface 24 for attachment to a structure.

Figure 5:
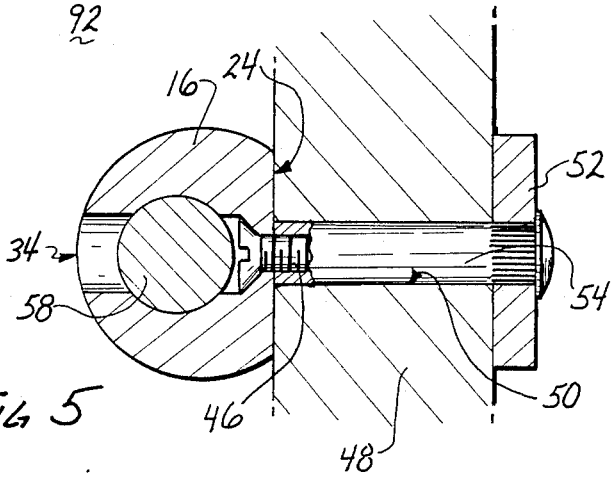
FIG. 5 is an end elevational view in section about the line 5—5 of FIG. 3 including a sectional view of a structure to which the multi-purpose lock bolt is attached.

Referring now to FIG. 5, the body 16 of the multi-purpose lock bolt 10 is shown attached to a structure 48 utilizing even a further method of mounting. A plow bolt 46 has been located in the mounting hole 38 with its head positioned in the counter sunk area 42 and its threads 48 extending beyond the back planar surface 24. In attaching the body 16 to this structure two holes, only one of which is seen, hole 50, have been drilled in the structure 48. A back plate 52 is positioned on the opposite side of the structure 48 from the body 16 and a carriage head threaded boss 54 passed through the back plate 52 into the hole 50. The body 16 is then attached to the carriage head threaded boss 54 via the plow bolt 46 which threads into the carriage threaded boss 54.

A bolt 56 slides into the bolt hole 26. The bolt 56 has a shaft 58 and a head 60. As is evident in FIG. 5 once the bolt 56 is located in the main body 16, the shaft 58 is positioned over the head of the plow bolt 46 preventing access to the plow bolt 46 and unauthorized removal of the body 16 from the structure 48. Thus, once the body 16 is mounted to the structure and the bolt 56 is positioned in the body 16 the presence of the bolt 56 prevents unauthorized access to the mounting implements used to attach the body 16 to the structure by sealing up the mounting holes 34 and 36 via positioning of the bolt shaft 58 intermediate the outer section 38 of these holes 34 and 36 and the inner section 40 of these holes 34 and 36.

The bolt 56 is conveniently formed as a surface of rotation. It can be appropriately machined on a lathe or the like in the form of a shaft 58 and a bolt head 60. The diameter of the shaft 58 is chosen with respect to the diameter of the bolt hole 26 such that the shaft 58 conveniently fits into and easily slides within the bolt hole 26. The diameter of the head 60, however, is oversized with respect to the diameter of the bolt hole 26 so as to abut against the surface 18 when, as seen in FIG. 1, the bolt 56 is pushed from right to left.

A first alignment hole 62 is formed in the bolt shaft 58. It is drilled in the bolt shaft 58 in a direction perpendicular to the elongated axis of the bolt 56. Additionally a further alignment hole 64, best seen in FIG. 4, is also formed in the bolt 56. The hole 64 is parallel to the hole 62. Both of the holes 62 and 64 as well as the lock shank hole 28 in the body 16 are sized to accept a variety of sizes of lock shackles.

The alignment hole 62 is positioned on the bolt shaft 58 such that when the bolt head 60 abuts against the surface 18 of the body 16, this positions the alignment hole 62 directly in line with the lock shank hole 28. With this construction a shackle 66 of a lock 68 can be passed through the upper section 28 of the lock shank hole 28, throu9h the alignment hole 62 in the bolt 56 and then through the lower section 32 of the lock shank hole 28 and finally rejoined back to the body 68 of the lock to lock the lock onto the body 16 and fixedly position the bolt 56 in a locked position.

The further alignment hole 64 allows for locking the bolt 56 in an unlocked position with respect to the body 16. This is seen in FIG. 1 wherein the shackle 66 of the lock 68 has been passed through the body 16 and through the further alignment hole 64 in the bolt 56 to lock the bolt 56 in an unlocked position.

Because the bolt hole 26, the lock shank hole 28 and the mounting holes 34 and 36 are all formed in mutually perpendicular positions in the body 16 with the mounting holes 34 and 36 on either side of the lock shank hole 28, the body 16 can be formed as a compact monolithic structure but still allow for three independent functions to occur in association with this. These, of course, are mounting of the body 16 to the structure, sliding of a bolt within the body 16 and positioning of a lock shackle in the body 16 through the bolt therein.

Further, because the mounting holes 34 and 36 are formed to have a different shape in their outer and inner sections, the outer section can be utilized to locate an attachment implement through the body 16 and the inner sections can be utilized to interact with the attachment implement to attach the body 16 to a structure. Additionally, once the bolt 56 is then inserted into the body 16, the presence of the bolt 56 itself prevents access to these attachment implements preventing their removal. An unauthorized person cannot simply drill out a soft attachment implement, as for instance, the plow bolt 46, but must contend with the bolt 56, which normally would be case hardened or the like to inhibit access to such attachment implements.

Once the body 16 is secured to a structure the bolt 56 is then inserted into the body 16. It is then retained in the body 16 via the use of a retaining member 70. A retaining hole 72 is drilled into the body 16 from the cylindrical surface 22 to the bolt hole 26. As can be seen in FIGS. 4 and 5 the bolt 56 includes a channel 74 formed therein along the longitudinal axis of the bolt 56.

The channel 74 extends into the bolt shaft 58 for a portion of the diameter of the bolt shaft 58 as seen in FIG. 6. However, the channel 74 only extends along a portion of the length of the bolt shaft 58 as is evident in FIG. 4. After the bolt 56 is located in the body 16, the retaining member 70 is driven into the retaining hole 72 positioning its end 76 in the channel 74.

The diameter of the retaining member 70 is chosen with respect to the width of the channel 74 to be slightly undersized with respect to the channel 74 allowing for the bolt 56 to slide along the retaining member 70 with the channel 74 in the bolt shaft 58 sliding along the end 76 of the retaining member 70. However, when the end 78 of the channel 74 contacts the end 76 of the retaining member 70 further movement of the bolt 56 to the right as seen in FIG. 4 is prevented. The limits of travel of the bolt 56 in the body 16 are thus governed by the bolt head 60 contacting the surface 18 when the bolt is pushed from right to left as seen in FIGS. 3 and 4 and contact of the retaining member 70 against the end 78 of the channel 74 when the bolt is moved from left to right as seen in FIGS. 3 and 4.

An auxiliary body 80 is formed as per the body 16 except that it does not include any lock shank openings. Further, instead of a bolt hole which extends completely through the auxiliary body 80 it has a bolt strike hole 82 which extends from face 84 towards, but does not intersect the opposite face 86 of the body 80. The bolt strike hole 82 is of the same diameter as the bolt hole 26 allowing for sliding of the bolt 56 into the strike hole 82. Since the surface 86 of the auxiliary body 80 is solid, a punch or other implement cannot be utilized to drive against the end 83 of the bolt 56 in an attempt to force the bolt 56 from the auxiliary body 80.

The auxiliary body 80 includes mounting holes, collectively identified by the numeral 88 which are sized and shaped exactly like the mounting holes 34 and 36 previously described for the main body 16 including having outer and inner sections (not separately numbered or identified) and countersunk and cylindrical areas (not separately identified or numbered). Thus, the auxiliary body 80 can be mounted to a structure in equivalent manners to those described above for the main body 16. When the bolt 56 is positioned in the auxiliary body 80 in a locked position, as with the main body 16, the presence of the bolt 56 in the bolt strike hole 82 prevents access to any mounting implements utilized to attach the auxiliary body 80 to a structure such as structure 14.

Both the main body 16 and the auxiliary body 80 can be formed from cylindrical bar steel by appropriately truncating the cylindrical shape of this bar steel to form a planar surface as per back planar surface 24 and then drilling the appropriate holes therein. This would be typically followed by case hardening these structures and applying an appropriate surface if desired, as for instance, anodization and the like. As is evident in FIGS. 6 and 7 in locating the bolt hole 26 in the body 16 or the bolt strike hole 82 in the auxiliary body 80, these holes are positioned off center from the cylindrical axis of the precursor cylinder material which was utilized to form these bodies. Thus, after a portion of this cylindrical material is truncated to form the planar surface, as for instance, the planar surface 24, the bolt hole 26 or the bolt strike hole 82 is essentially centered in the material remaining in the bodies 16 and 80.

While for the purposes of this specification the lock shank hole 28 has been described as being perpendicular to the bolt hole 26 it could be set at an oblique angle, however, since drilling of such an oblique hole in the essentially cylindrical body 16 increases the manufacturing difficulties thereof it is preferred to maintain the mutually perpendicular relationship of the bolt hole 26, the lock shank hole 28 and the mounting holes 34 and 36.

The multi-purpose lock bolt 10 of the invention can be utilized in a variety of ways in a variety of structures. As is seen in FIG. 1, the body 16 including the bolt 56 located therein is utilized on the structure 12 in conjunction with utilization of the auxiliary body 80 on the structure 14. Thus, the structures 12 and 14 are locked together with respect to movement in any direction which is perpendicular to the elongated axis of the bolt 56 by positioning the bolt 56 in its locked position in the body 16 such that its end 83 as seen in FIG. 4 extends into and is located in the strike hole 82 in the auxiliary body 80.

Figure 2:
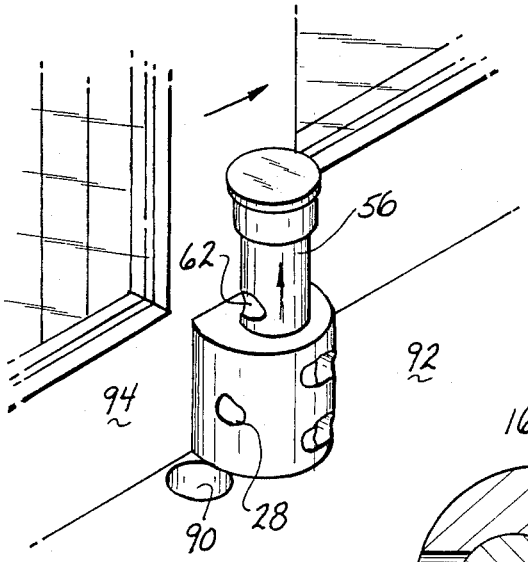
FIG. 2 is an isometric view similar to FIG. 1 showing a second use of the multi-purpose lock bolt of the invention on a different structure.

Alternatively, the multi-purpose lock bolt 10 could be utilized simply with the main body 16 and the bolt 56. This is as seen in FIG. 2. In this utilization a opening 90 would be formed in an appropriate structure 92 as for instance a door frame or the like. The body 16 of the multi-purpose lock bolt 10 is attached to a door 94 as was described above. This door 94 is then locked to the structure 92 by sliding the bolt 56 into the body 16 such that its end 83 projects into and engages the opening 90.

As is evident from the geometry of both the main body 16 and the auxiliary body 80 they are capable of being positioned along the edge of a door which, because it is very narrow, does not serve as a suitable foundation for other locking structures. Further, they can be positioned on the edges of narrow gates, aluminum door frames and the like. The multi-purpose lock bolt 10 of the invention can be utilized to lock single or double swinging doors, sliding doors, swinging garage doors and the like. It can be utilized to prevent movement of the door either in a swinging mode, a lifting mode or a sliding mode.

I claim:

1. A multi-purpose lock-bolt which comprises:

a body;

said body shaped as a cylinder having end surfaces and a cylindrical surface truncated by a plane passing parallel to the cylindrical axis of said cylinder and through both of said end surfaces and said cylindrical surface;

said body including a bolt hole, a lock shackle hole and a mounting hole each located in and passing through said body;

said lock shackle hole intersecting with and tranversing across said bolt hole whereby said bolt hole divides said lock shackle hole into two sections;

said mounting hole intersecting with and traversing across said bolt hole whereby said bolt hole divides said mounting hole into two sections;

an elongated bolt, said bolt sized and shaped to fit into and slide in said bolt hole, said bolt sliding in said bolt hole between an extended locked position wherein a portion of said bolt extends out from said bolt hole beyond said body and a retracted unlocked position wherein said same portion of said bolt is essentially retracted into said body; and said elongated bolt including an alignment hole extending through said bolt in a direction transverse to the elongated dimension of said elongated bolt, said alignment hole positioned in said bolt and said lock shackle hole positioned in said body in association with each other such that said alignment hole aligns with said lock shackle hole when said bolt is in said locked position whereby a lock shackle can be passed through both of said lock shackle hole and said alignment hole to fixedly position said bolt in said locked position in said body.

2. The lock-bolt of claim 1 wherein:

each of said bolt hole, said lock shackle hole and said mounting hole are located in said body in positions which are mutually perpendicular to each other.

3. The lock-bolt of claim 1 wherein said body includes two of said mounting holes, each of said mounting holes located perpendicular to said bolt hole and traversing across said bolt hole so as to be divided into sections by said bolt hole.

4. The lock-bolt of claim 3 wherein:

said sections of said each of said mounting holes in said body are of different sizes so as to allow a mounting. implement to be passed through one of said sections of each of said mounting holes, through said bolt hole and be at least partly retained in said body by the other of said sections of each of said mounting holes.

5. The lock-bolt of claim 1 wherein.

said body further includes a retaining member hole, said retaining member hole positioned essentially perpendicular to said bolt hole and passing through a portion of said body from an outside surface of said body to said bolt hole;

said bolt including an elongated groove formed in a surface of said bolt along the elongated dimension of said bolt; said groove located on said bolt so as to align with said retaining member hole in said body when said bolt is located in said bolt hole; and further including a bolt retaining member, said bolt retaining member sized and shaped to be positionable in said retaining member hole and to extend from said retaining member hole into said groove on said bolt to movably retain said bolt in said body.

6. The lock-bolt of claim 1 including:

an auxiliary body;

said auxiliary body including a bolt strike hole and at least one mounting hole located in said auxiliary body in mutually perpendicular positions;

said mounting hole intersecting with and traversing across said bolt strike hole whereby said bolt strike hole divides said mounting hole into two sections; and said bolt strike hole extending at least partially into said auxiliary body from a surface of said body towards an opposite surface of said body and sized and shaped to accept a portion of said bolt wherein said bolt inhibits movement of said auxiliary body with respect to said body about two axes which are perpendicular to the elongated dimension of said bolt.

7. The lock-bolt of claim 6 wherein:

said body is a monolithic body and said auxiliary body is a monolithic body.

8. The lock-bolt of claim 7 wherein: said auxiliary body is shaped as a cylinder having end surfaces and a cylindrical surface truncated by a plane passing parallel to the cylindrical axis of said cylinder and through both of said end surfaces and said cylindrical surface.

9. The lock-bolt of claim 8 wherein:

said bolt extends through said body from one of its end surfaces to the other of its end surfaces; and said bolt strike hole extends through said auxiliary body from one of its end surfaces towards the other of its end surfaces.

10. The lock-bolt of claim 1 wherein:

said bolt further includes a further alignment hole extending through said bolt in a direction transverse to the elongated dimension of said bolt and parallel with said alignment hole, said further alignment hole positioned in said bolt and said lock shackle hole positioned in said body in association with each other such that said further alignment hole aligns with said lock shackle hole when said bolt is in said unlocked position whereby a lock shackle can be passed through both of said lock shackle hole and said further alignment hole to fixedly position said bolt in said unlocked position in said body with said portion of said bolt essentially retracted into said body.

11. The lock-bolt of claim 1 wherein:

said body is a monolithic body.

12. A multi-purpose lock-bolt which comprises:

a monolithic body, said body shaped as a cylinder having opposing end surfaces and a cylindrical surface between said end surface and truncated by a plane passing parallel to the cylindrical axis of said cylinder through both of said end surfaces and said cylindrical surface to form a plane surface;

said body including a bolt hole, a lock shackle hole and a mounting hole each located in and passing through said body;

said bolt hole extending from one of said end surfaces to the other of said end surfaces;

said lock shackle hole extending from a first position on said cylindrical surface to an opposite position on said cylindrical surface and intersecting with and traversing across said bolt hole;

said mounting hole located in at least said plane surface;

an elongated bolt, said bolt sized and shaped to fit into and slide in said bolt hole, said bolt sliding in said bolt hole between an extended locked position wherein a portion of said bolt extends out from said bolt hole beyond one of said end surfaces of said body and a retracted unlocked position wherein said same portion of said bolt is essentially retracted into said body; and said bolt including an alignment hole extending through said bolt in a direction transverse to the elongated dimension of said bolt, said alignment hole positioned in said bolt and said lock shackle hole positioned in said body in association with each other such that said alignment hole aligns with said lock shackle hole when said bolt is in said locked position whereby a lock shackle can be passed through both of said lock shackle hole and said alignment hole to fixedly position said bolt in said locked position in said body.

13. The lock-bolt of claim 12 including:

at least two of said mounting holes spaced apart from each other in said plane surface.

14. The lock-bolt of claim 13 wherein:

each of said mounting holes extends from said plane surface perpendicular to said bolt hole and traverses across said bolt hole and extends through said cylindrical surface so as to be divided into sections by said bolt hole; and said sections of said each of said mounting holes in said body of different sizes to allow a mounting implement to be passed from said cylindrical surface through one of said sections of each of said mounting holes and through said bolt hole and be at least partly retained in said body by the other of said sections of each of said mounting holes.

15. The lock-bolt of claim 12, wherein:

said body includes a retaining member hole, said retaining member hole positioned in association with said bolt hole and passing through a portion of said body from said cylindrical surface of said body to said bolt hole;

said bolt including an elongated groove formed in a surface of said bolt along the elongated dimension of said bolt; said groove located on said bolt so as to align with said retaining member hole in said body when said bolt is located in said bolt hole; and further including a bolt retaining member, said bolt retaining member sized and shaped to be positionable in said retaining member hole and to extend from said retaining member hole into said groove on said bolt to movably retain said bolt in said body.

16. The lock-bolt of claim 12 further including:

a monolithic auxiliary body; said auxiliary body also shaped as a cylinder having opposing end surfaces and a cylindrical surface between said end surface and truncated by a plane passing parallel to the cylindrical axis of said cylinder through both of said end surfaces and said cylindrical surface to form a plane surface;

said auxiliary body including a bolt strike hole and at least one mounting hole located in said auxiliary body; and said bolt strike hole extending from one of the end surfaces of said auxiliary body at least partially into said auxiliary body from said end surface towards the other of said end surfaces of said auxiliary body and sized and shaped to except a portion of said bolt.

17. A multi-purpose lock-bolt which comprises:

a monolithic body, said body shaped as a cylinder having opposing end surfaces and a cylindrical surface between said end surfaces and truncated by a plane passing parallel to the cylindrical axis of said cylinder through both of said end surfaces and said cylindrical surface to form a plane surface;

said body including a bolt hole, a lock shackle hole and at least two mounting holes each located in and passing through said body;

said bolt hole extending from one of said end surfaces to the other of said end surfaces;

said lock shackle hole extending from a first position on said cylindrical surface to an opposite position on said cylindrical surface perpendicular to said bolt hole and intersecting with and traversing across said bolt hole;

each of said mounting holes extending from said plane surface perpendicular to said bolt hole and traverse across said bolt hole and extending through said cylindrical surface;

an elongated bolt, said bolt sized and shaped to fit into and slide in said bolt hole, said bolt sliding in said bolt hole between an extended locked position wherein a portion of said bolt extends out from said bolt hole beyond one of said end surfaces of said body and a retracted unlocked position wherein said same portion of said bolt is essentially retracted into said body; and said bolt including an alignment hole extending through said bolt in a direction transverse to the elongated dimension of said bolt, said alignment hole positioned in said bolt and said lock shackle hole positioned in said body in association with each other such that said alignment hole aligns with said lock shackle hole when said bolt is in said locked position whereby a lock shackle can be passed through both of said lock shackle hole and said alignment hole to fixedly position said bolt in said locked position in said body.

18. The lock-bolt of claim 17 further including:

a monolithic auxiliary body; said auxiliary body also shaped as a cylinder having opposing end surfaces and a cylindrical surface between said end surfaces and truncated by a plane passing parallel to the cylindrical axis of said cylinder through both of said end surfaces and said cylindrical surface to form a plane surface;

said auxiliary body including a bolt strike hole and at least one mounting hole located in said auxiliary body; and said bolt strike hole extending from one of the end surfaces of said auxiliary body at least partially into said auxiliary body from said end surface towards the other of said end surfaces of said auxiliary body and sized and shaped to accept a portion of said bolt.

19. The lock-bolt of claim 17 wherein:

said bolt is formed as a surface of rotation and includes an elongated shaft section and an enlarged head section;

said shift section being sized and shaped to fit into and move within said bolt hole in said body; and said enlarged head section being sized and shaped to be excluded from said bolt hole in said body whereby said alignment hole is positioned in alignment with said lock shackle hole by said head section contacting an end surface of said body.

* * * * *

UNITED STATES PATENT AND TRADEMARK OFFICE

CERTIFICATE OF CORRECTION

PATENT NO. : 4, 861,079

DATED : AUGUST 29, 1989

INVENTOR(S) : WILLIAM DE FORREST, SR.

It is certified that error appears in the above-identified patent and that said Letters Patent is hereby corrected as shown below·

Column 1, line 60, "traversing" should be --traverse--.

Column 4, line 49, "28" should be --30--.

Column 4, line 50, "throu9h" should be --through--.

Column 6, line 45, "a" should be --an--.

Column 8, line 25, insert --hole-- between "bolt" and "extends".

Column 10, line 61, "shift" should be --shaft--.

Signed and Sealed this

Twentieth Day of November, 1990

*Attest:*

*Attesting Officer*

HARRY F. MANBECK, JR.

*Commissioner of Patents and Trademarks*